US005565288A

United States Patent [19]

Watanabe et al.

[11] Patent Number: 5,565,288

[45] Date of Patent: Oct. 15, 1996

[54] ELECTROPHOTOGRAPHIC PHOTORECEPTOR

[75] Inventors: Kazumasa Watanabe; Shingo Fujimoto; Yuanhu Pei; Toyoko Shibata, all of Hino, Japan

[73] Assignee: Konica Corporation, Tokyo, Japan

[21] Appl. No.: 425,428

[22] Filed: Apr. 20, 1995

[30] Foreign Application Priority Data

Apr. 26, 1994 [JP] Japan ..... 6-088812
Oct. 27, 1994 [JP] Japan ..... 6-264054

[51] Int. Cl.[6] ..... G03G 5/047
[52] U.S. Cl. ..... 430/59; 430/70
[58] Field of Search ..... 430/58, 59, 70, 430/96

[56] References Cited

U.S. PATENT DOCUMENTS 5,176,976 1/1993 Kikuchi et al. ..... 430/58
5,213,923 5/1993 Yokoyama et al. ..... 430/58

*Primary Examiner*—John Goodrow
*Attorney, Agent, or Firm*—Frishauf, Holtz, Goodman, Langer & Chick, P.C.

[57] ABSTRACT

An electrophotographic photoreceptor comprises a carrier transport material, wherein the material is a benzoquinone compound represented by the following Formula (1) or (2):

Formula (1)

Formula (2)

wherein $Ar_1$ and $Ar_2$ independently represent an aryl group or an aromatic heterocyclic group; Z, $Z_1$ and $Z_2$ independently represent $=C(CN)_2$, $=C(CO_2R')$, $=C(CN)(CO_2R)$, $=C(CN)(COR)$ or $=N(CN)$ in which R and R' represent a substituted or unsubstituted alkyl or aryl group; and B represents an arylene group or a divalent aromatic heterocyclic group.

6 Claims, 1 Drawing Sheet

ELECTROPHOTOGRAPHIC PHOTORECEPTOR

FIELD OF THE INVENTION

The present invention relates to an electrophotographic photoreceptor for forming an electrostatic latent image, and particularly to an electrophotographic photoreceptor comprising a layer containing a compound capable of transporting an electron.

BACKGROUND OF THE INVENTION

In the conventional electrophotographic photoreceptor inorganic photoconductive compounds such as selenium, zinc oxide and silicon has been widely used as main components, however, these compounds are not satisfactory in view of sensitivity, heat resistance, humidity resistance or durability. Further, some of these compounds are harmful to human body, and have a problem on discarding.

Recently, the studies on organic electrophotographic photoreceptors, which comprise a photoconductive layer containing organic photoconductive compounds, have been eagerly made. Most of organic electrophotographic photoreceptors have a functionally separated structure which consists of a charge generation layer (hereinafter referred to as a CGL) containing a charge generation material such as an azo compound, a phthalocyanine or a multi-condensed ring containing pigment and a charge transport layer (hereinafter referred to as a CTL) containing a charge transport material.

As the charge transport material pyrazolines, hydrazones, triphenylamine compounds and styryl derivatives thereof are well known, however, these compounds are capable of transporting a hole. In a functionally separated type electrophotographic photoreceptor having a CGL as a lower layer and a CTL as an upper layer the surface of the photoreceptor requires to be negatively charged. Therefore, the conventional developer used in inorganic photoreceptors can not be used. Ozone occurred when the electrophotographic photoreceptor was charged by corona-charger is more as compared with positively charged inorganic electrophotographic photoreceptors. A reversely layered electrophotographic photoreceptor having a CTL as a lower layer and a CGL as an upper layer and a single layered electrophotographic photoreceptor containing a charge transport material and a charge generation material in admixture are positively charging, but not satisfactory in view of durability and sensitivity.

In order to solve the above problems, materials capable of transporting an electron are necessary as a charge transport material. As these materials 2,4,6-trinitrofluorenone is known as a charge transport material. However, this compound has poor compatibility with a polymer binder, and has not sufficient properties as a photoconductive layer. Further, this compound causes cancer and can not be used.

Recently, several electron transport materials having a solubilizing group in an electron accepting structure are reported. These materials are described, for example, Japanese Patent O.P.I. Publication Nos. 2-135362/1990, 2-214866/1990, and 3-290666/1991.

The fluorenone compounds disclosed in Japanese Patent O.P.I. Publication No. 5-279582/1993 and "Robunshu, Japan Hard Copy, '92, p. 173" are excellent compounds giving low residual potential and high sensitivity, however, the photoreceptor containing these compounds has problems that residual potential is increased when charge & exposure proceeds on it repeatedly. The quinone compounds disclosed in Japanese Patent O.P.I. Publication No. 1-206349/1989 are excellent electron transport compounds having no plural nitro groups which is said to induce cancer, but have problems that residual potential is high.

SUMMARY OF THE INVENTION

An object of the invention is to provide an electrophotographic photoreceptor containing an electron transport material capable ofi transporting an electron which gives high sensitivity, low residual potential, and excellent durability that the electrophotographic properties do not vary in repeated use.

DETAILED DESCRIPTION OF THE INVENTION

Figure 1:
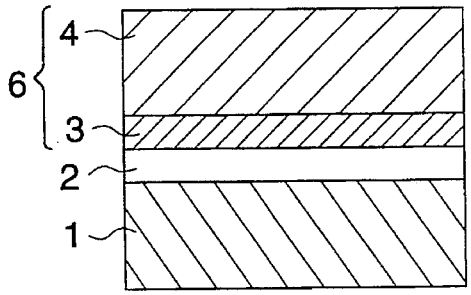
FIGS. 1A through 1F show examples of the electrophotographic photoreceptor of the invention.
Figure 1:
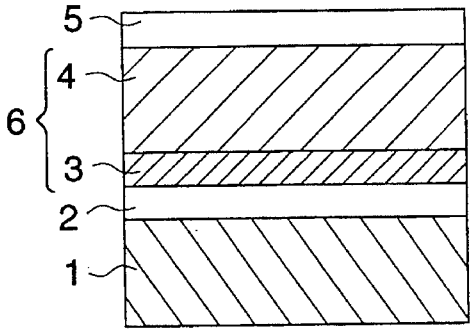
Figure 1:
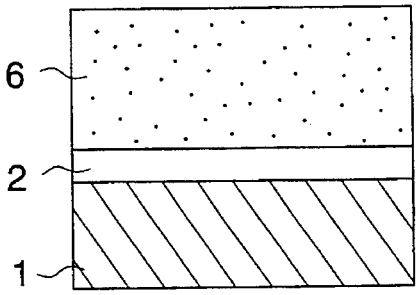
Figure 1:
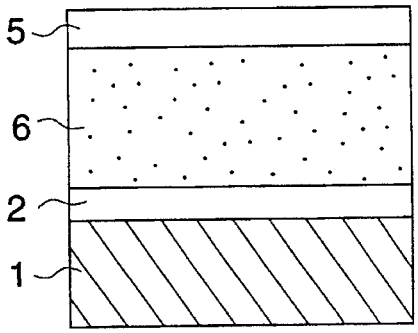
Figure 1:
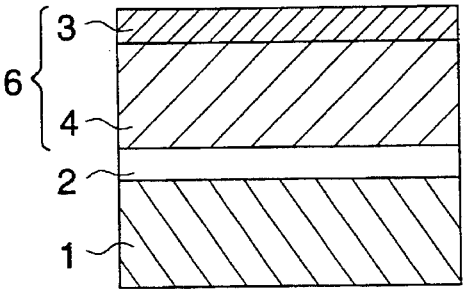
Figure 1:
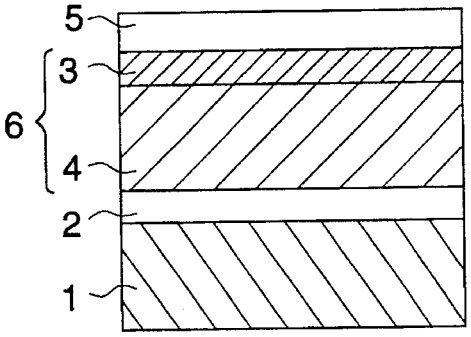

The above object of the invention can be attained by an electrophotographic photoreceptor comprising a specific 2,6-disubstituted benzoquinone compound as an effective component.

The above benzoquinone compound includes a compound represented by the following Formula (1) or (2):

Formula (1)

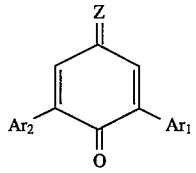

Formula (2)

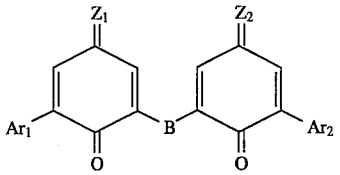

wherein $Ar_1$ and $Ar_2$ independently represent a substituted or unsubstituted aryl or aromatic heterocyclic group; Z, $Z_1$ and $Z_2$ independently represent $=C(CN)_2$, $=C(CO_2R)(CO_2R')$, $=C(CN)(CO_2R)$, $=C(CN)(COR)$ or $=N(CN)$in which R and R' represent a substituted or unsubstituted alkyl or aryl group; and B represents an arylene group or a divalent aromatic heterocyclic group.

The aryl group represented by $Ar_1$ and $Ar_2$ includes a substituted or unsubstituted phenyl or naphthyl group, and the aromatic heterocyclic group represented by $Ar_1$ and $Ar_2$ includes a substituted or unsubstituted pyridyl, furyl, pyrrolyl or thiophenyl group. Of these a substituted or unsubstituted phenyl group is preferable, and the substituent includes an alkyl group, an alkoxy group, a phenyl group, a halogen atom, a cyano group or a nitro group. The alkyl group of R and R' includes a methyl, ethyl, butyl or octyl group. The aryl group of R and R' includes a phenyl, tolyl, xylyl or naphthyl group. The substituent of the alkyl and aryl group represented by R and R' includes an alkyl groups, an alkoxy group, a phenyl group, a halogen atom, a cyano group or a nitro group. The example of B includes a phenylene or naphthylene group. In Formula (2), it is preferable that $Z_1$ is the same as $Z_2$.

The above compound of the invention can be synthesized by various processes. The example of the synthetic processes will be shown in the following Diagram 1 and 2.

The compound shown represented by Formula (1) of the invention is obtained according to processes shown in Diagram 1.

Dibenzyl ketones are obtained from benzylcyanide derivatives and phenylacetatederivatives, and then are condensed with nitro malondialdehyde to obtain 2,6-diphenyl-4-nitrophenol derivatives, followed by oxidation to obtain the corresponding quinone substituent. Subsequently, the quinone substituent is reacted with malonitrile or malonate. Thus, the compound shown represented by Formula (1) of the invention is obtained.

The compound shown represented by Formula (2) of the invention is obtained in the same process as above, except that xylylcyanide is used instead of benzylcyanide. The synthetic example of compound 2-1 will be shown in Diagram 2.

Diagram 1

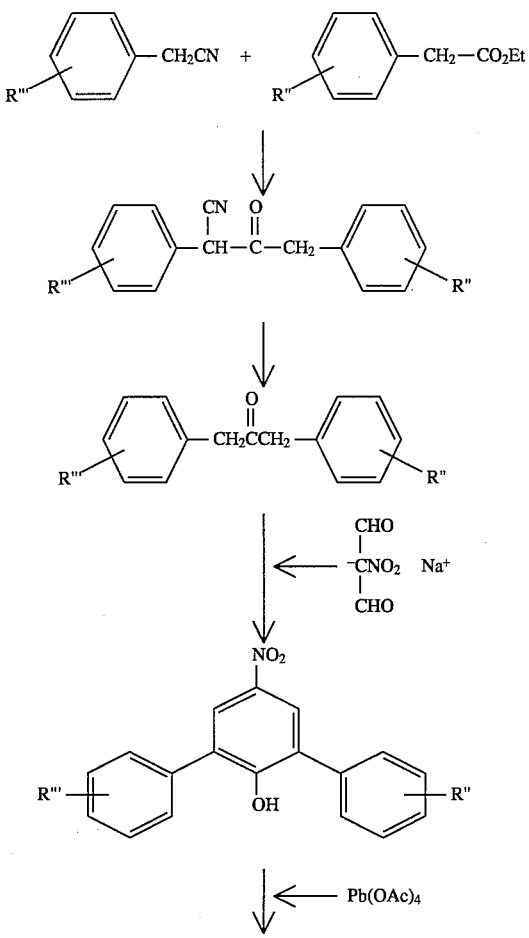

-continued

Diagram 1

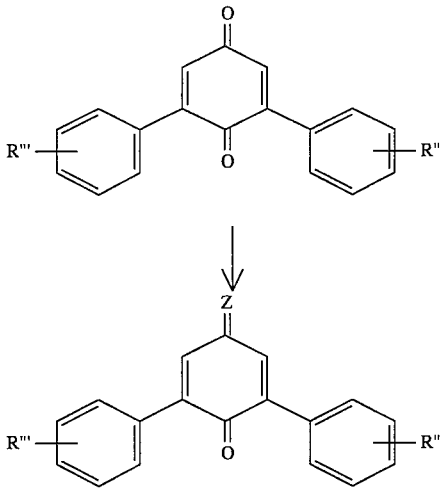

Diagram 2

Synthesis of compound 2-1

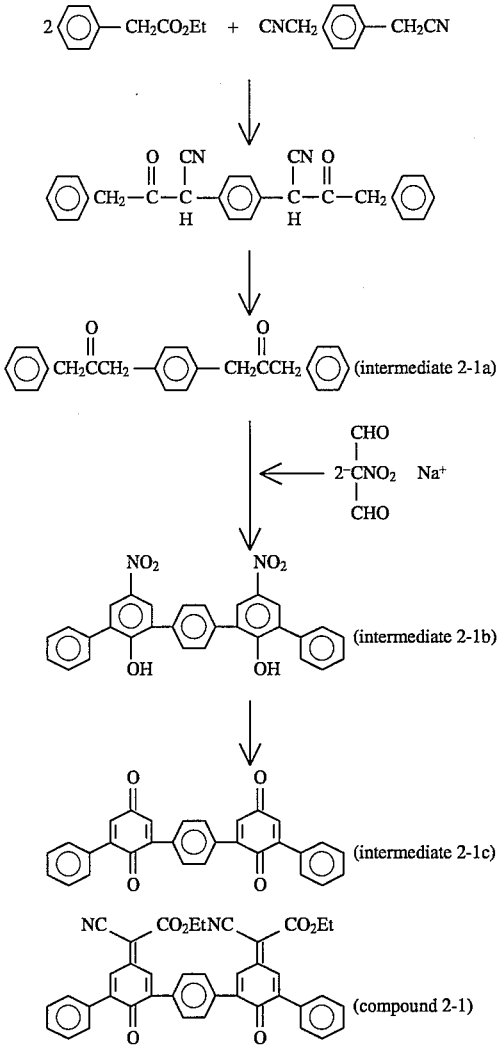

SYNTHETIC EXAMPLE 1

Synthesis of Compound 1—1

(Synthesis of Intermediate 1-(p-Chlorophenyl)-3-Phenyl-2-Propanone)

This compound was synthesized according to description on page 174, Organic Synthesis Col. Vol. 4.

In 400 ml of ethanol was dissolved 112 g of potassium-butoxide and a mixture of 76.5 g p-chlorobenzylcyanide and 90.0 g ethyl phenylacetate was added. The resulting solution was refluxed for 3 hours and cooled. The resulting solution was poured into 2 litre of water and the oil-soluble substance was extracted with toluene. To the resulting water phase was added hydrochloric acid and precipitate was filterd out to obtain precipitates (97 g).

The precipitate was dispersed in 60% sulifuric acid solution (130 ml concentrated surfuric acid +180 ml water) and hydrolyzed at 130° C. After 15 hours, the dispersion was cooled, washed with water and extracted with toluene. The toluene solution was washed with an alkali solution and then water. The resulting solution was evaporated iunder reduced pressure to remove the solvent and solidified in a refrigerator. (97 g)

To a mixtuere of 300 ml ethanol and 120 ml iwater were added 19.5 g of sodium 2-nitro malondialdehyde and 30 g of 1-(p-chlorophenyl)-3-phenyl-2-propanone) and dissolved by heating. The solution was cooled to room temperature with stirring, mixed with an alkali solution of 10 g hydroxide and 20 ml water and stirred at room temperature for further 5 hours. Thereafter, 100 ml water were added thereto. No precipitation was observed at this time. The resulting solution was mixed with 30 ml acetic acid and the resulting mixture was filtered out to obtain precipitate (34.2 g).

(Synthesis of Intermediate 2-(p-Chlorophenyl)-6-Phenyl-p-Benzoquinone)

Oxidation reaction was carried out according to description of J. Kenner et al., J. Chem. Soc., 679 (1934). In 200 ml acetic acid were dispersed 16.2 g of 2-(p-chlorophenyl)-6-phenyl-2-nitrophenol. To the dispersion were added little by little 11.5 g of lead tetraacetate and stirred at room temperature for further 6 hours. The resulting mixture was filtered out to obtain precipitate (34.2 g). The precipitate was washed with acetic acid to obtain orange crystal (11.0 g).

In 120 ml tetrahydrofuran were dissolved 2.95 g of intermediate 2-(p-chlorophenyl)-6-phenyl-p-benzoquinone) while heating. To the solution were added 3.10 g of butyl-cyanoacetate and cooled with ice.

To the solution were added dropwise at not more than 10° C. 20 ml of a carbon tetrachloride solution containing 6 ml titanium tetrachloride. Thereafter, 8 ml of pyridine were added dropwise at not more than 10° C. The resulting solution was stirred at room temperature for 3 hours, allowed to stand overnight and mixed with water to stop reaction. The resulting mixture was extracted with toluene. The toluene solution was chromatographed using silica gel column and toluene developer. The resulting solution was evaporated under reduced pressure and was mixed with methanol to obtain precipitate (2.2 g).

Synthesis of Compound 1-48

In 120 ml dichloromethane were dissolved 2.95 g of intermediate 2-(p-chlorophenyl)-6-phenyl-p-benzoquinone. To the solution were added 1.70 g of cyanoacetophenone and cooled with ice.

To the solution were added dropwise at not more than 10° C. 20 ml of a carbon tetrachloride solution containing 6 ml titanium tetrachloride. Thereafter, 8 ml of pyridine were added dropwise at not more than 10° C. The resulting solution was stirred at room temperature for 3 hours, allowed to stand overnight and mixed with water to stop reaction. The resulting mixture was extracted with toluene. The toluene solution was chromatographed using silica gel column and toluene developer. The resultiong solution was mixed with methanol to obtain compound 1-48 (2.7 g).

Synthesis of Compound 1-54

In 60 ml dichloromethane were dissolved 3.0 g of intermediate 2-(p-methylphenyl)-6-phenyl-p-benzoquinone, cooled with ice to 0°–5° C., added 2.5 g of titanium tetrachloride and stirred for 30 minutes. To the solution were added 2.4 g of bis(tritylsilyl)carbondiimide while keeping at 0°–5° C., and then stirred at room temperature for further 4 hours. Thereafter, the solution was mixed with water to stop reaction. The resulting mixture was extracted with toluene. The toluene solution was chromatographed using silica gel column and toluene developer. The resultiong solution was mixed with methanol to obtain compound 1-54 (2.3 g).

The typical emample of the invention will be shown below, but the compound of the invention is not limited thereto.

Exemplified compound

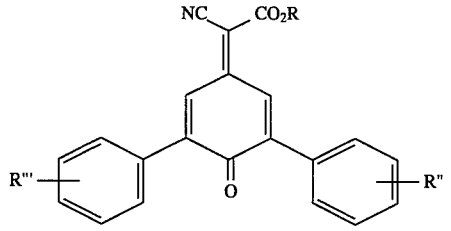

| Compound No. | R | R'' | R''' |
|---|---|---|---|
| 1-1 | (n)$C_4H_9$ | 4-Cl | H |
| 1-2 | (n)$C_4H_9$ | H | H |
| 1-3 | (n)$C_4H_9$ | 4-$CH_3$ | H |
| 1-4 | $CH_3$ | 4-$CH_3$ | H |
| 1-5 | (n)$C_4H_9$ | 2-F | H |
| 1-6 | (n)$C_4H_9$ | 3-F | H |
| 1-7 | (n)$C_4H_9$ | 4-$OCH_3$ | H |
| 1-8 | (n)$C_4H_9$ | 3-$CF_3$ | H |
| 1-9 | (n)$C_4H_9$ | 3-$NO_2$ | H |
| 1-10 | $C_2H_5$ | 2-F | 3-$CF_3$ |
| 1-11 | $C_2H_5$ | 2-$CH_3$-4-Cl | H |
| 1-12 | $C_2H_5$ | 2-$CH_3$-4-Cl | 3-$CH_3$ |
| 1-13 | $C_2H_5$ | 2-Cl-4-Cl | 4-$CH_3$ |
| 1-14 | $C_2H_5$ | 3-Br | 4-$C_6H_5$ |
| 1-15 | $CH_3$ | 3-$CH_3$ | 4-$C_6H_5$ |
| 1-16 | $CH_2C_6H_5$ | 4-$CH_3$ | H |
| 1-17 | $CH_2C_6H_5$ | 3-$CH_3$ | H |
| 1-18 | $CH_2C_6H_5$ | 4-$C_6H_5$ | H |
| 1-19 | $CH_2C_6H_5$ | H | H |
| 1-20 | $C_6H_5$ | 3-$CH_3$ | H |

-continued

Exemplified compound

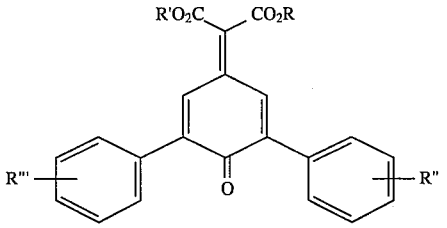

| Compound No. | R | R' | R" | R"' |
|---|---|---|---|---|
| 1-21 | $C_2H_5$ | $C_2H_5$ | 4-Cl | H |
| 1-22 | $C_2H_5$ | $C_2H_5$ | H | H |
| 1-23 | $C_2H_5$ | $C_2H_5$ | 4-$CH_3$ | H |
| 1-24 | $C_2H_5$ | $C_2H_5$ | 2-$CH_3$-4-Cl | 3-$CH_3$ |
| 1-25 | $C_2H_5$ | $C_2H_5$ | 2-Cl-4-Cl | 4-$CH_3$ |
| 1-26 | $CH_3$ | $CH_3$ | 4-Cl | H |
| 1-27 | $CH_3$ | $CH_3$ | H | H |
| 1-28 | $CH_3$ | $CH_3$ | 4-$CH_3$ | H |
| 1-29 | $CH_3$ | $CH_3$ | 4-$CH_3$ | 3-$CH_3$ |
| 1-30 | $CH_3$ | $CH_3$ | 3-$CF_3$ | 3-$CF_3$ |
| 1-31 | $CH_3$ | $CH_3$ | 2-$CH_3$-4-Cl | H |
| 1-32 | $CH_3$ | $CH_3$ | 2-Cl-4-Cl | $CH_3$ |
| 1-33 | $CH_2C_6H_5$ | $CH_2C_6H_5$ | 4-$CH_3$ | H |
| 1-34 | $CH_2C_6H_5$ | $CH_2C_6H_5$ | 4-$NO_2$ | H |
| 1-35 | $CH_2C_6H_5$ | $CH_2C_6H_5$ | H | H |
| 1-36 | $C_2H_5$ | $C_6H_5$ | H | H |

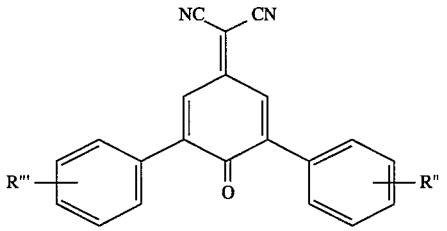

| Compound No. | R" | R"' |
|---|---|---|
| 1-37 | 4-Cl | H |
| 1-38 | H | H |
| 1-39 | 4-$CH_3$ | H |
| 1-40 | 4-$CH_3$ | 4-$CH_3$ |
| 1-41 | 4-$CH_3$ | 3-$CH_3$ |
| 1-42 | 4-$CH_3$ | 2-$CH_3$ |
| 1-43 | 4-$OCH_3$ | 4-$CH_3$ |
| 1-44 | 3-$OCH_3$ | H |
| 1-45 | 3-$OC_6H_5$ | H |
| 1-46 | 4-$C_6H_5$ | H |
| 1-47 | 4-$C_6H_5$ | 4-$CH_3$ |

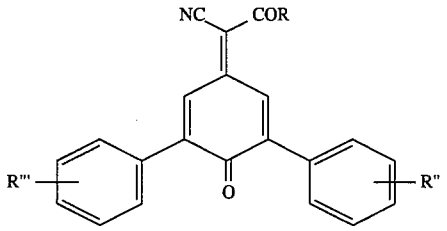

| Compound No. | R | R" | R"' |
|---|---|---|---|
| 1-48 | $C_6H_5$ | 4-Cl | H |
| 1-49 | $C_6H_5$ | 2-Cl | H |
| 1-50 | $C_6H_5$ | 4-$CH_3$ | H |
| 1-51 | $4CH_3C_6H_5$ | 4-Cl | H |
| 1-52 | $C_2H_5$ | H | H |

-continued

Exemplified compound

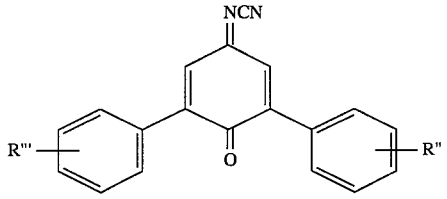

| Compound No. | R" | R"' |
|---|---|---|
| 1-53 | 4-Cl | H |
| 1-54 | 4-$CH_3$ | H |
| 1-55 | 4-$CH_3$ | 4-$CH_3$ |
| 1-56 | H | H |
| 1-57 | 3-Cl | 3-Cl |
| 1-58 | 4-$OCH_3$ | H |

SYNTHETIC EXAMPLE 2

Synthesis of Compound 2-1

(Synthesis of Intermediate 2-1a)

To a dispersion of 400 ml toluene and 112 g potassiumt-butoxide was added a mixture solution in which 65.0 g p-xylylcyanide and 165.0 g ethyl phenylacetate were dissolved in 500 ml toluene by heating. The resulting solution was refluxed for 3 hours and cooled. The resulting white potassium salt was obtained by filtering. The potassium salt is dissolved in 2 liter water, mixed with hydrochloric acid and the resultion mixture was filtered out to obtain white crystal.

The crystal wasi dispersed in 60% sulfuric acid solution (130 ml concentrated surfuric acid + 180 ml water) and hydrolyzed at 130° C. After 15 hours, the dispersion was cooled, diluted with water and extracted with toluene. The toluene solution was washed with an alkali solution and then water. The resulting solution was evaporated under reduced pressure to remove the solvent and solidified in a refrigerator. (130 g)

(Synthesis of Intermediate 2-1b)

To a mixture solution of 400 ml ethanol and 50 ml water were added 19.5 g of sodium 2-nitro malondialdehyde salt and 20 g of intermediate (2-1a) and dissolved by heating. The solution was cooled to room temperature with stirring, mixed with an alkali solution of 10 g hydroxide and 20 ml water and stirred at room temperature for further 5 hours. Thereafter, 100 ml water were added thereto. No precipitation was observed at this time. The resulting solution was mixed with 30 ml acetic acid and the resulting mixture was filtered out to obtain precipitate (16.2 g).

(Synthesis of Intermediate 2-1c)

In acetic acid were dispersed 15.0 g of intermediate (2-1b). To the dispersion were added little by little 12.0 g of lead tetraacetate and stirred at room temperature for further 6 hours. The resulting mixture was filtered out to obtain precipitate. The precipitate was washed with acetic acid to obtain orange crystal (9.0 g).

In 160 ml anhydrous tetrahydrofuran were dissolved 4.42 g of intermediate 2-1c and 4.23 g of ethyl cyanoacetate. To the solution was added dropwise at 0°–10° C. with stirring under nitrogen atmosphere a mixture 9 ml titanium tetrachloride and 20 ml of carbon tetrachloride. Thereafter, the solution was stirred for 30 minutes, 10 ml of pyridine were added dropwise at 0°–10° C., and stirred at room temperature for further 3 hours.

Thereafter, the resulting solution was poured in 500 ml pure water and extracted with 800 ml toluene. The toluene solution was washed with 10% hydrochloric acid and then, washed twice with 400 ml of pure water. The resulting solution was dried over anhydrous magnesium sulfate. Thereafter, the toluene was removed, and the resulting residue was chromatographed using silica gel column and toluene. The resulting solution was evaporated and the residue was recrystalized from ethanol to obtain compound (2-1) (4.5 g).

SYNTHETIC EXAMPLE 3

(Synthesis of Compound 2-7

In 120 ml dichloromethane were dissolved 4.42 g of intermediate 2-1c. To the solution was added dropwise at 0°–10° C. with stirring under nitrogen atmosphere a mixture of 5.7 ml titanium tetrachloride and 20 ml of dichloromethane. Thereafter, the solution was stirred for 30 minutes, then 5.58 g of bis(trimethylsilyl)carbodiimide were added dropwise at 0°–10° C., further stirred at room temperature for further 6 hours and allowed tostand overnight.

Thereafter, the resulting solution was poured in 500 ml pure water and extracted with 800 ml dichloromethane. The dichloromethane solution was washed twice with 400 ml of pure water. The resulting solution was dried over anhydrous magnesium sulfate. Thereafter, the dichloromethane was removed, and the resulting residue was chromatographed using silica gel column. The resultiong was recrystalized to obtain compound (2-7) (4.0 g).

The typical emample of the invention represented by Formula (2) will be shown below.

Exemplified compound

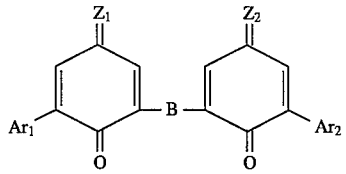

| Compound No. | B | $Ar_1$ | $Ar_2$ | $Z_1$ | $Z_2$ |
|---|---|---|---|---|---|
| 2-1 | 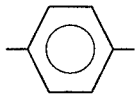 | 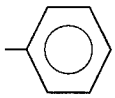 | 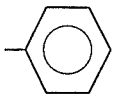 | $:C(CN)CO_2C_2H_5$ | $:C(CN)CO_2C_2H_5$ |
| 2-2 | 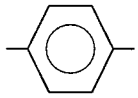 | 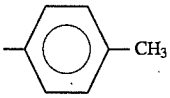 | 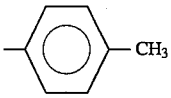 | $:C(CN)CO_2C_4H_9$ | $:C(CN)CO_2C_4H_9$ |
| 2-3 | 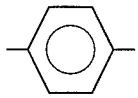 | 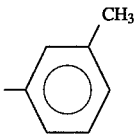 | 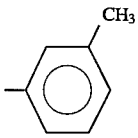 | $:C(CN)CO_2C_4H_9$ | $:C(CN)CO_2C_4H_9$ |
| 2-4 | 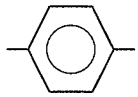 | 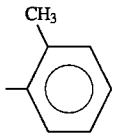 | 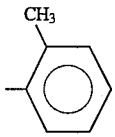 | $:C(CN)_2$ | $:C(CN)_2$ |
| 2-5 | 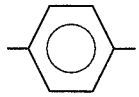 | 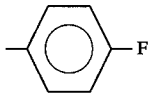 | 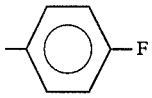 | $:C(CO_2C_2H_5)_2$ | $:C(CO_2C_2H_5)_2$ |
| 2-6 | 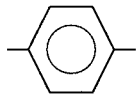 | 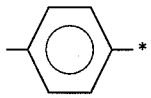 | 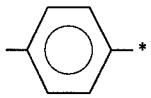 | $:C(CN)COCH_3$ | $:C(CN)COCH_3$ |
| | | $*tC_4H_9$ | $*tC_4H_9$ | | |

-continued
Exemplified compound
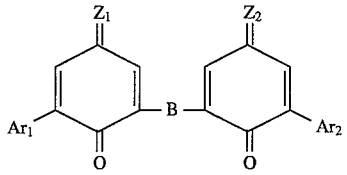
| Compound No. | B | $Ar_1$ | $Ar_2$ | $Z_1$ | $Z_2$ |
|---|---|---|---|---|---|
| 2-7 | 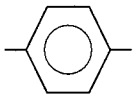 | 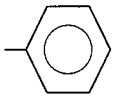 | 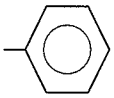 | :N—CN | :N—CN |
| 2-8 | 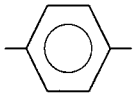 | 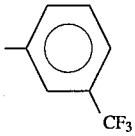 | 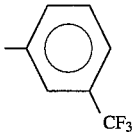 | :N—CN | :N—CN |
| 2-9 | 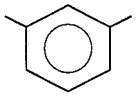 | 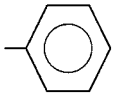 | 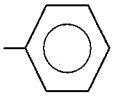 | :C(CN)$CO_2C_2H_5$ | :C(CN)$CO_2C_2H_5$ |
| 2-10 | 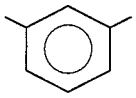 | 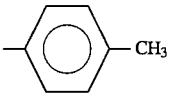 | 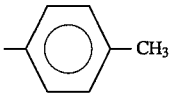 | :C(CN)$CO_2C_4H_9$ | :C(CN)$CO_2C_4H_9$ |
| 2-11 | 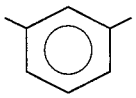 | 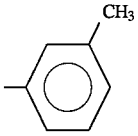 | 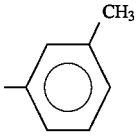 | :C(CN)$CO_2C_4H_9$ | :C(CN)$CO_2C_4H_9$ |
| 2-12 | 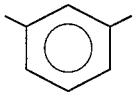 | 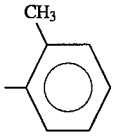 | 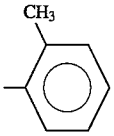 | :$C(CN)_2$ | :$C(CN)_2$ |
| 2-13 | 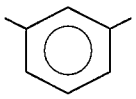 | 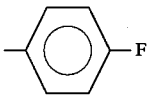 | 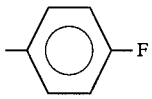 | :$C(CO_2C_2H_5)_2$ | :$C(CO_2C_2H_5)_2$ |
| 2-14 | 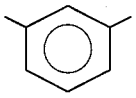 | 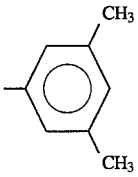 | 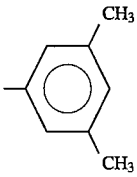 | :NCN | :NCN |
| 2-15 | 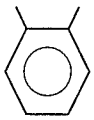 | 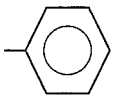 | 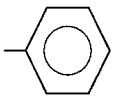 | :C(CN)$CO_2C_4H_9$ | :C(CN)$CO_2C_4H_9$ |
| 2-16 | 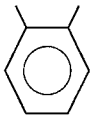 | 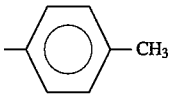 | 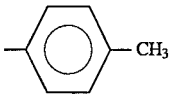 | :C(CN)$CO_2C_4H_9$ | :C(CN)$CO_2C_4H_9$ |

-continued
Exemplified compound
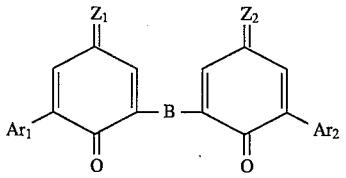
| Compound No. | B | $Ar_1$ | $Ar_2$ | $Z_1$ | $Z_2$ |
|---|---|---|---|---|---|
| 2-17 | 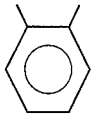 | 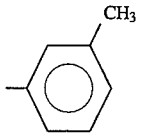 | 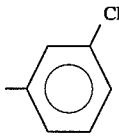 | $:C(CN)CO_2C_2H_5$ | $:C(CN)CO_2C_2H_5$ |
| 2-18 | 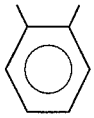 | 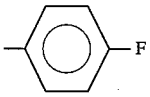 | 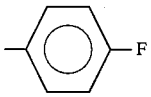 | $:C(CO_2C_2H_5)_2$ | $:C(CO_2C_2H_5)_2$ |
| 2-19 | 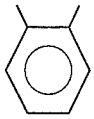 | 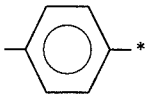 | 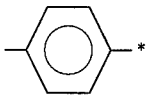 | $:C(CN)COCH_3$ | $:C(CN)COCH_3$ |
| | | $*tC_4H_9$ | $*tC_4H_9$ | | |
| 2-20 | 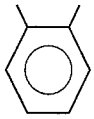 | 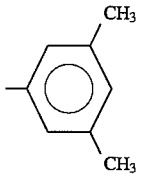 | 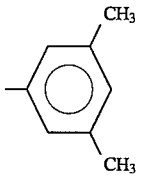 | :NCN | :NCN |
| 2-21 | 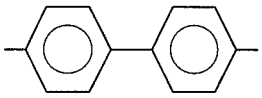 | 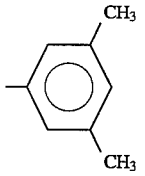 | 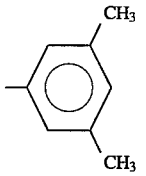 | $:C(CN)CO_2C_2H_5$ | $:C(CN)CO_2C_2H_5$ |
| 2-22 | 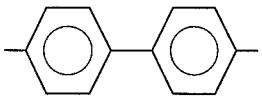 | 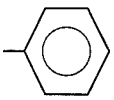 | 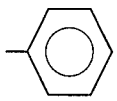 | $:C(CN)_2$ | $:C(CN)_2$ |
| | | $*C_4H_9$ | $*C_4H_9$ | | |
| 2-23 | 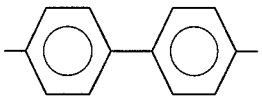 | 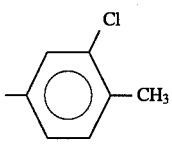 | 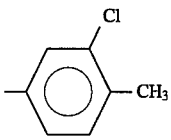 | :NCN | :NCN |
| 2-24 | 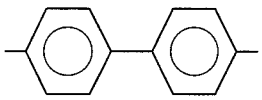 | 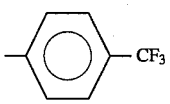 | 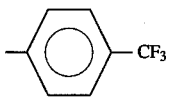 | $:C(CO_2C_2H_5)_2$ | $:C(CO_2C_2H_5)_2$ |
| 2-25 | 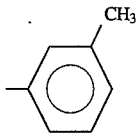 | 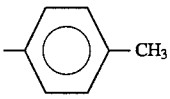 | 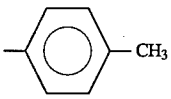 | $:C(CN)CO_2C_2H_5$ | $:C(CN)CO_2C_2H_5$ |

-continued
Exemplified compound
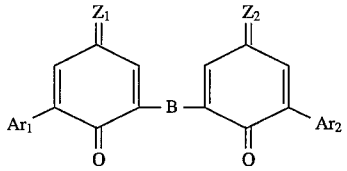
| Compound No. | B | $Ar_1$ | $Ar_2$ | $Z_1$ | $Z_2$ |
|---|---|---|---|---|---|
| 2-26 | 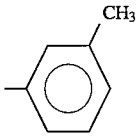 | 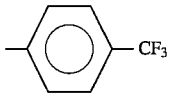 | 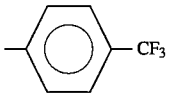 | :NCN | :NCN |
| 2-27 | 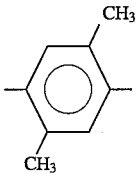 | 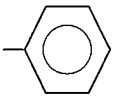 | 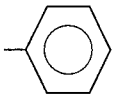 | :C(CN)$CO_2C_4H_9$ | :C(CN)$CO_2C_4H_9$ |
| 2-28 | 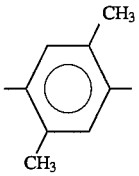 | 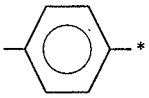 *$tC_4H_9$ | 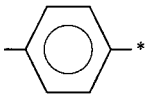 *$tC_4H_9$ | :$C(CN)_2$ | :$C(CN)_2$ |
| 2-29 | 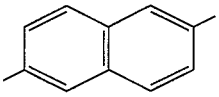 | 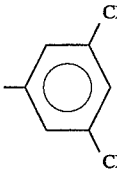 | 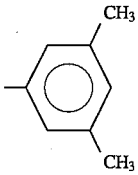 | :C(CN)$CO_2C_4H_9$ | :C(CN)$CO_2C_4H_9$ |
| 2-30 | 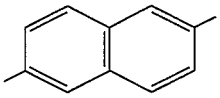 | 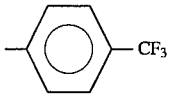 | 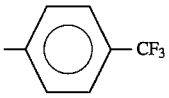 | :NCN | :NCN |
| 2-31 | 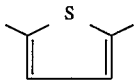 | 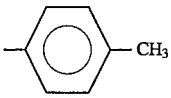 | 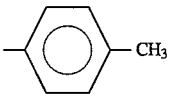 | :C(CN)$CO_2C_2H_5$ | :C(CN)$CO_2C_2H_5$ |
| 2-32 | 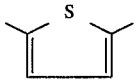 | 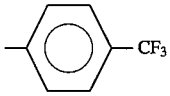 | 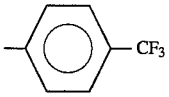 | :NCN | :NCN |
| 2-33 | 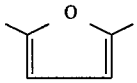 | 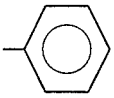 | 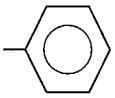 | :C(CN)$CO_2C_4H_9$ | :C(CN)$CO_2C_4H_9$ |
| 2-34 | 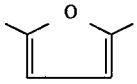 | 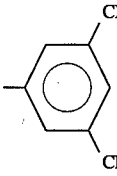 | 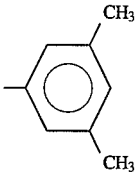 | :$C(CN)_2$ | :$C(CN)_2$ |

The compound of the invention has an excellent electron transport capability. The compound is molecular dispersed in a binder and can be incorporated in various layers of an electrophotographic photoreceptor. For example, the compound is added to a charge transport layer of a function separating negatively charging photoreceptor to obtain a positively charging electrophotographic photoreceptor. In a single layered positively charging electrophotographic photoreceptor, the compound is mixed with pigment whereby the pigment content can be decreased. The compound can be added to a protective layer provided in a positively charging electrophotographic photoreceptor. Further, the compound can be added to a charge generation layer or ian intermediate layer provided in a negatively charging electrophotographic photoreceptor whereby high sensitivity is obtained.

The electrophotographic photoreceptor of the invention has a photoconductive layer on a conductive support. The photoconductive layer of the invention comprises various structures shown in FIGS. 3A through 3F. FIG. 3A shows an electrophotographic photoreceptor comprising a support 1 and provided thereon, an intermediate layer 2, a charge generation layer 3 and a charge transport layer 4 in this order. FIG. 3B shows an electrophotographic photoreceptor comprising a support 1 and a photoconductive layer 6 comprising an intermediate layer 2, a charge generation layer 3, a charge transport layer 4 and a protective layer 5 provided on the support in this order. FIG. 3C shows an electrophotographic photoreceptor comprising a support and a photoconductive layer comprising an intermediate layer and a charge generation layer in this order. FIG. 3D shows an electrophotographic photoreceptor comprising a support and provided thereon, an intermediate layer, a charge generation layer and a protective layer in this order. FIG. 3E shows an electrophotographic photoreceptor comprising a support and provided thereon, an intermediate layer, a charge transport layer and a charge generation layer in this order. FIG. 3F shows an electrophotographic photoreceptor comprising a support and provided thereon, an intermediate layer, a charge transport layer, a charge generation layer and a protective layer in this order.

The binder used for dispersing the compound of the invention includes polycarbonate resins, polystyrene resins, polyacryl resins, polymethacryl resins, polyvinyl chloride resins, polyvinyl acetate resins, phenol resins, epoxy resins, silicone resins, polyester resins or copolymers thereof.

When the compound of the invention is used in a function separating charge transport layer, the content is preferably 20 to 200 parts by weight based on the 100 parts by weight of the binder used. The thickness of the charge transport layer is preferably 5 to 30 μm. In ithe single layer containing a binder, charge transport material and charge generation material, the content ratio of the binder, charge transport material and charge generation material is preferably 100: (1 to 200) : (1 to 200) (by weight), and the thickness of the single layer is preferably 5 to 40 μm. In the electrophotographic photoreceptor is used the conventional charge generation material, which includes, for example, an inorganic photoconductor such as selenium, various phthalocyanine compounds, azo compounds, pyrylium compounds, squaraine dyes, and multi-condensed quinone compounds.

The anti-oxidant can be used in the photoconductive layer of the invention to prevent deterioration due to ozone. The anti-oxidant includes hindered phenol compounds, hindered amine compounds, hydroquinones and organic phosphor compounds.

EXAMPLES

The invention will de detailed in the following examples, but is not limited thereto. In the Examples "parts" is in terms of weight parts.

Example 1

A polyester film support having a vapor-deposited alumunium layer was coated by means of a wire bar with a dispersion solution in which one part of Y type titanyl phthalocyanine and 0.5 parts of a silicone-butyral resin were dispersed in 50 parts of tert-butyl acetate using a sand mill. Thus, a charge generation layer was formed to have a thickness of 0.3 μm. On the charge generating layer was coated by means of a doctor blade a solution in which one part of exemplified compound shown in Table 1 and 1.5 parts of polycarbonate resin IUPILON Z200 produced by Mitsubishi Gasukagaku Co., Ltd. were dissolved in 10 parts of 1,2-dichloroethane to obtain a charge transfer layer having a thickness of 20 μm. Thus, inventive samples Nos. 1—1 through 1–10 were obtained.

Comparative Example 1

Comparative sample was prepared in the same manner as in Example 1, except that the following comparative compounds (C-1) and (C-2) were used instead of the compound of the invention. Thus, sample Nos. 1–11 and 1–12 were obtained.

Comparative compound

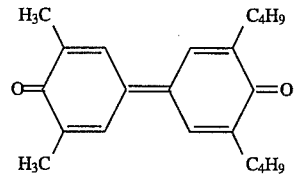

(C-1)

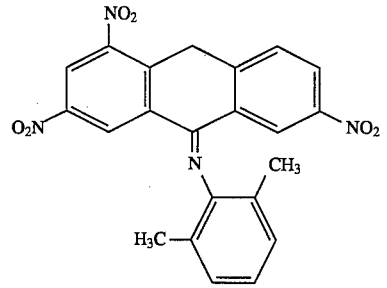

(C-2)

The above obtained samples were evaluated using Electrostatic Paper Analyzer EPA-8100 produced by Kawaguchi Denki Co. The samples were charged with 6 kv for 5 seconds by corona discharge to measure charging capability (accepted potential, Va), allowed to stand for 5 seconds iin the dark to measure initial potential, Vi, and exposed to 8 lux of white light for 10 seconds. Exposure E1/2 (lux.sec.) necessary to obtain half of initialspotential was measured and defined as sensitivity. The potential remained after the 10 second exposure was defined as residual potential, $V_r$.

The samples were processed in the same manner as above, except that before the charging, pre-exposure (1000 lux, 2 seconds) was carried out. This processing was repeated 300 times. Thereafter, variation of residual poyential, $\Delta V_r$ was measured.

The results are shown in Table 1.

As is apparent from Table 1, the inventive samples give high accepted potential, high sensitivity and low residual potential. To the contrary, the comparative compound C-1 gives high residual potential, although the compound has a quinone skeleton, and the comparative compound C-2 gives remarkable increase of variation of residual potential $\Delta V_r$ in the repeated process, although the compound gives low residual potential.

TABLE 1

| Sample No. | Compound No. | $V_a$ (Volt) | $V_i$ (Volt) | E1/2 (lux · sec.) | $V_r$ (Volt) | $\Delta V_r$ (Volt) | Remarks |
|---|---|---|---|---|---|---|---|
| 1-1 | 1-1 | 1120 | 877 | 0.50 | 49 | 150 | Invention |
| 1-2 | 1-2 | 1300 | 1026 | 0.50 | 56 | 160 | Invention |
| 1-3 | 1-3 | 1213 | 944 | 0.44 | 63 | 180 | Invention |
| 1-4 | 1-4 | 1150 | 910 | 0.40 | 40 | 110 | Invention |
| 1-5 | 1-26 | 1185 | 890 | 0.70 | 150 | 250 | Invention |
| 1-6 | 1-30 | 1310 | 1060 | 0.65 | 110 | 210 | Invention |
| 1-7 | 1-43 | 1040 | 810 | 1.05 | 30 | 90 | Invention |
| 1-8 | 1-50 | 1310 | 1090 | 0.85 | 130 | 270 | Invention |
| 1-9 | 1-53 | 1080 | 850 | 0.62 | 59 | 180 | Invention |
| 1-10 | 1-57 | 1130 | 920 | 0.68 | 61 | 160 | Invention |
| 1-11 | C-1 | 1380 | 1180 | 1.15 | 350 | 810 | Comparative |
| 1-12 | C-2 | 1250 | 910 | 0.50 | 50 | 750 | Comparative |

EXAMPLE 2

A coating solution for an intermediate layer was prepared, which consists of 14 g of titanium chelate compound (T), 6 g of silane coupling agent (Si), 200 ml of isopropyl alcohol and 50 ml of ethyl alcohol. The coating solution was coated on an aluminium plate using a doctor blade and dried at 150° C. for 30 minutes to have an intermediate layer having a thickness of 0.7. On the intermediate layer was coated by means of a wire bar a dispersion solution, in which one part of Y type titanyl phthalocyanine and 0.5 parts of a silicone-butyral resin were dispersed in 50 parts of tert-butyl acetate using a sand mill, to obtain a charge generation layer having a thickness of 0.2 μm. On the charge generating layer was coated by means of a doctor blade a solution, in which one part of exemplified compound shown in Table 2 and 1.5 parts of polycarbonate resin Yupilon Z200 produced by Mitsubishi Gasukagaku Co., Ltd. were dissolved in 10 parts of 1,2-dichloroethane, to obtain a charge transport layer having a thickness of 22 μm. Thus, inventive sample Nos. 2-1 through 2-8 were obtained.

Comparative Example 2

Comparative sample No. 2-1 was prepared in the same manner as in Example 2, except that the following comparative compound (C-3) was used instead of the compound of the invention.

The chemical structures of (T), (Si) and (C-3) are as follows:

Comparative compound (T)

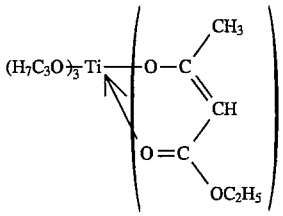

-continued

Comparative compound (Si)

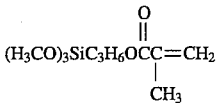

-continued

Comparative compound (C-3)

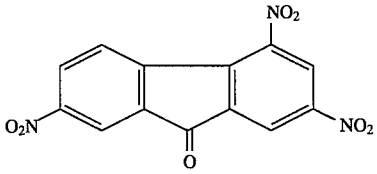

The above obtained samples were evaluated using electric paper tester EPA-8100 produced by Kawaguchi Denki Co. The samples were charged with 6 kv for 5 seconds by corona discharge to measure charging capability (accepted potential, Va), allowed to stand for 5 seconds in the dark to measure initial potential, Vi, and exposed to 8 lux of white light for 10 seconds. Exposure E1/2 (lux.sec.) necessary to obtain half of initial potentialswas measured and defined as sensitivity. The potential remained after the 10 second exposure was defined as residual potential, $V_r$.

The results are shown in Table 2.

As is apparent from Table 2, the inventive samples give high accepted potential, high sensitivity and low residual potential. To the contrary, ithe comparative compound C-3 gives high residual potential and low sensitivity.

TABLE 2

| Sample No. | Compound No. | $V_a$ (Volt) | E1/2 (lux · sec.) | $V_r$ (Volt) | Remarks |
|---|---|---|---|---|---|
| 2-1 | 2-2 | 1250 | 0.55 | 52 | Invention |
| 2-2 | 2-4 | 1050 | 0.85 | 70 | Invention |
| 2-3 | 2-8 | 1180 | 0.60 | 60 | Invention |
| 2-4 | 2-11 | 1250 | 0.51 | 45 | Invention |
| 2-5 | 2-17 | 1180 | 0.48 | 60 | Invention |
| 2-6 | 2-19 | 1280 | 0.65 | 80 | Invention |
| 2-7 | 2-27 | 1310 | 0.58 | 45 | Invention |
| 2-8 | 2-31 | 1150 | 0.75 | 95 | Invention |
| 2-1 | C-3 | 980 | 2.50 | 360 | Comparative |

What is claimed is:

1. An electrophotographic photoreceptor comprising a carrier transport material, wherein the material is a benzoquinone compound represented by the following Formula (1) or (2):

Formula (1)

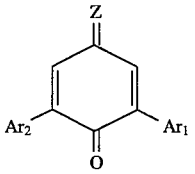

Formula (2)

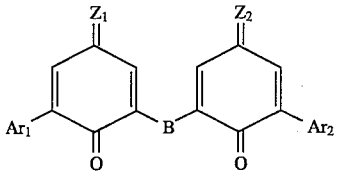

wherein $Ar_1$ and $Ar_2$ independently represent a substituted or unsubstituted aryl or aromatic heterocyclic group; Z, $Z_1$ and $Z_2$ independently represent $=C(CN)_2$, $=C(CO_2R)$ $(CO_2R')$, $=C(CN)$ $(CO_2R)$, $=C(CN)$ (COR) or =N(CN) in which R and R' independently represent a substituted or unsubstituted alkyl or aryl group; and B represents an arylene group or a divalent aromatic heterocyclic group.

2. The electrophotographic photoreceptor of claim 1, wherein said $Ar_1$ and $Ar_2$ in Formulas (1) and (2) independently represent a substituted or unsubstituted phenyl or naphthyl group, a pyridyl group, a furyl group, a pyrrolyl group or a thiophenyl group; said substituted or unsubstituted alkyl group in Formulas (1) and (2) independently represent a methyl, ethyl, butyl or octyl group; said substituted or unsubstituted aryl group in Formulas (1) and (2) independently represent a phenyl, tolyl, xylyl or naphthyl group; and B represents a phenylene or naphthylene group.

3. The electrophotographic photoreceptorof claim 1, wherein the substituent of said phenyl or naphthyl group represents an alkyl group, an alkoxy group, a phenyl group, a halogen atom, a cyano group or a nitro group.

4. The electrophotographic photoreceptorof claim 1, wherein said $Ar_1$ and $Ar_2$ in Formulas (1) and (2) independently represent a substituted or unsubstituted phenyl group.

5. The electrophotographic photoreceptor of claim 1, wherein said $Z_1$ and $Z_2$ in Formula (2) are the same group.

6. An electrophotographic photoreceptor comprising a conductive support, and provided thereon, a carrier transport layer containing a carrier transport material and a carrier generation layer containing a carrier generation material, wherein the material is a benzoquinone compound represented by the following Formula (1) or (2):

Formula (1)

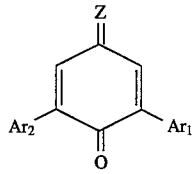

Formula (2)

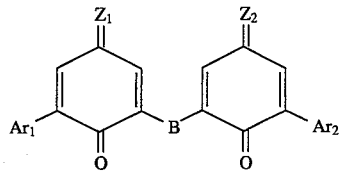

wherein $Ar_1$ and $Ar_2$ independently represent a substituted or unsubstituted aryl or aromatic heterocyclic group; Z, $Z_1$ and $Z_2$ independently represent $=C(CN)_2$, $=C(CO_2R)$ $(CO_2R')$, $=C(CN)$ $(CO_2R)$, $=C(CN)$ (COR) or =N(CN) in which R and R' represent a substituted or unsubstituted alkyl or aryl group; and B represents an arylene group or a divalent aromatic heterocyclic group.

* * * * *